US011247875B2

(12) United States Patent
Kuparinen

(10) Patent No.: US 11,247,875 B2
(45) Date of Patent: Feb. 15, 2022

(54) STS CRANE

(71) Applicant: KONECRANES GLOBAL CORPORATION, Hyvinkää (FI)

(72) Inventor: Toni Kuparinen, Hyvinkää (FI)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 202 days.

(21) Appl. No.: 16/499,923

(22) PCT Filed: Apr. 3, 2018

(86) PCT No.: PCT/FI2018/050239
§ 371 (c)(1),
(2) Date: Oct. 1, 2019

(87) PCT Pub. No.: WO2018/185370
PCT Pub. Date: Oct. 11, 2018

(65) Prior Publication Data

US 2020/0115193 A1 Apr. 16, 2020

(30) Foreign Application Priority Data

Apr. 3, 2017 (FI) ..... 20175306

(51) Int. Cl.
*B66C 7/08* (2006.01)
*B66C 5/08* (2006.01)
(Continued)

(52) U.S. Cl.
CPC ..... *B66C 7/08* (2013.01); *B66C 5/08* (2013.01); *B66C 7/10* (2013.01); *B66C 11/16* (2013.01); *B66C 13/04* (2013.01); *B63B 27/12* (2013.01)

(58) Field of Classification Search
CPC .... B66C 7/08; B66C 5/08; B66C 7/10; B66C 11/16; B66C 13/04; B66C 11/18;
(Continued)

(56) References Cited

U.S. PATENT DOCUMENTS 3,718,263 A * 2/1973 Strecke ..... B66C 7/00 212/333
7,410,339 B2 * 8/2008 Franzen ..... B66C 19/002 212/318
(Continued)

FOREIGN PATENT DOCUMENTS

CN 105000480 A 10/2015
DE 39 37 080 A1 5/1991
(Continued)

OTHER PUBLICATIONS

International Search Report, issued in PCT/FI2018/050239, dated Jun. 27, 2018.
(Continued)

*Primary Examiner* — Lynn E Schwenning
(74) *Attorney, Agent, or Firm* — Birch, Stewart, Kolasch & Birch, LLP

(57) ABSTRACT

An STS crane (Ship-to Shore) includes a portal frame structure; a boom which has a portion extending on a ship's side as well as a portion extending on a quay side; a trolley moving along the boom; a hoisting mechanism which has a rope drum for hoisting ropes, whereby the hoisting ropes are routed from the rope drum through boom ends to the trolley; auxiliary trolleys which move along the boom on both sides of the trolley to support and/or tighten the hoisting ropes; and a folding joint on the boom portion extending on the ship's side for folding up the folding portion of the boom extending to the direction of the ship from the folding joint; whereby there are auxiliary trolley rails arranged for the auxiliary trolleys, these auxiliary trolley rails being separate
(Continued)

Figure 1:
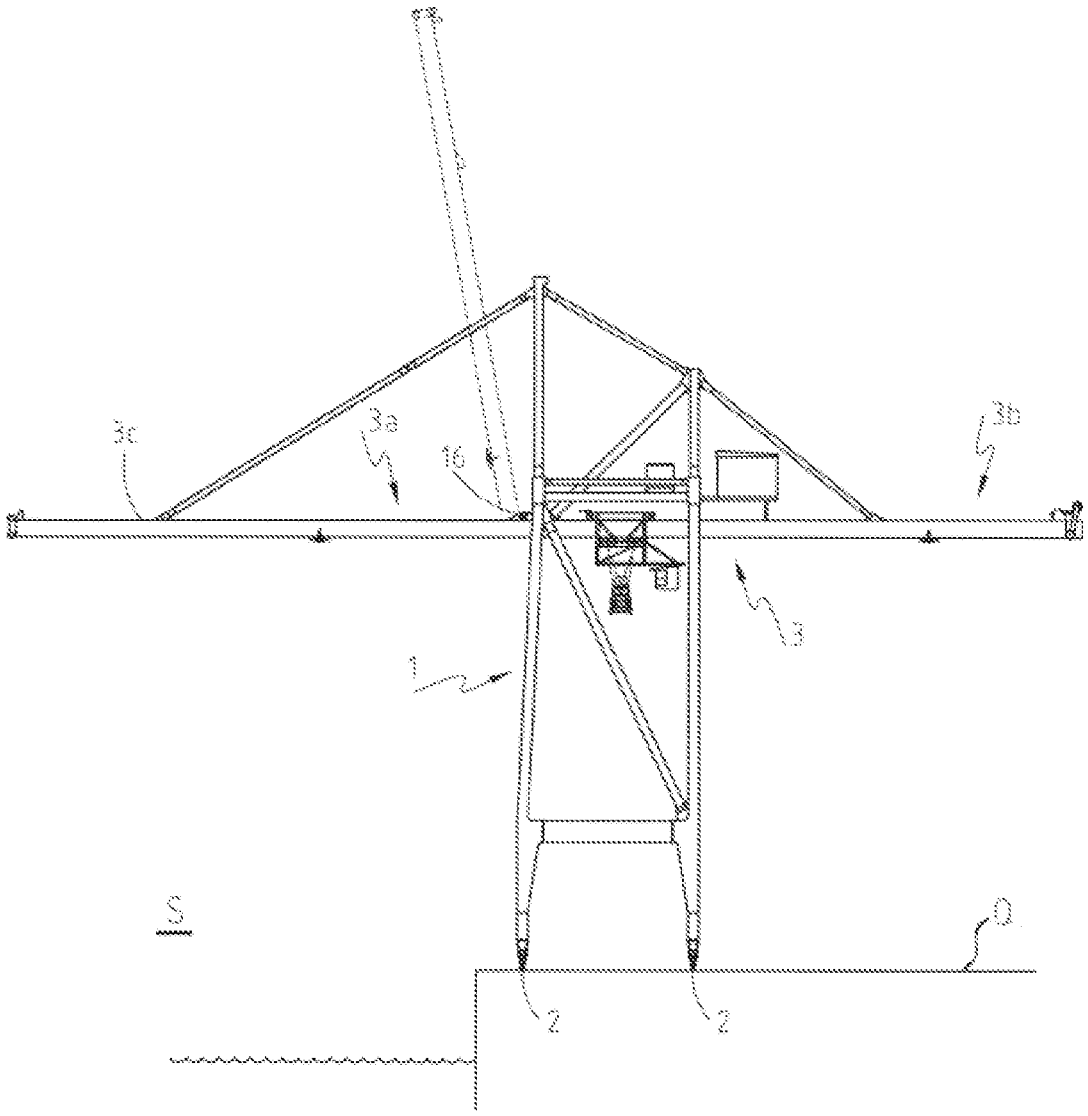

from the trolley rails; and whereby the drive roping of the auxiliary trolleys is divided into two separate and independent drive ropings which have separate and independent drive mechanisms and which are on different sides of the folding joint on the boom.

11 Claims, 2 Drawing Sheets

(51) Int. Cl.

| | |
|---|---|
| ***B66C 7/10*** | (2006.01) |
| ***B66C 11/16*** | (2006.01) |
| ***B66C 13/04*** | (2006.01) |
| *B63B 27/12* | (2006.01) |

(58) Field of Classification Search
CPC ..... B66C 11/20; B66C 13/10; B66C 19/002; B63B 27/12
See application file for complete search history.

(56) References Cited

U.S. PATENT DOCUMENTS

| | | | | |
|---|---|---|---|---|
| 9,950,879 | B2 * | 4/2018 | Toncelli | B66C 1/02 |
| 2005/0218100 | A1 | 10/2005 | Takehara et al. | |
| 2010/0021272 | A1 | 1/2010 | Ward et al. | |

FOREIGN PATENT DOCUMENTS

| | | | |
|---|---|---|---|
| JP | 59-230995 | A | 12/1984 |
| JP | 1-78684 | U | 5/1989 |
| JP | 9-175781 | A | 7/1997 |
| JP | 2000-136086 | A | 5/2000 |
| JP | 2012-201450 | A | 10/2012 |

OTHER PUBLICATIONS

Written Opinion of the International Searching Authority, issued in PCT/FI2018/050239, dated Jun. 27, 2018.

* cited by examiner

STS CRANE

BACKGROUND OF THE INVENTION

The invention relates to an STS crane (Ship-to Shore) which comprises a portal frame structure; a boom which is supported to a top part of the portal frame structure and which has a portion intended to extend on a ship's side as well as a portion intended to extend on a quay side; a trolley adapted to move along the boom, supported by trolley rails arranged on it, a hoisting mechanisms which is arranged on top of the boom and which has a rope drum for hoisting ropes, whereby the hoisting ropes are routed from the rope drum through boom ends to the trolley; auxiliary trolleys which are arranged to move along the boom on both sides of the trolley to support and/or tighten the hoisting ropes; a drive mechanism and a drive roping of the auxiliary trolleys to move the auxiliary trolleys; and a folding joint on the boom portion intended to extend on the ship's side for folding up the folding portion of the boom extending to the direction of the ship from the folding joint.

In an STS crane, the trolley moves along the entire length of the boom to get on top of a container to be lifted. With a long boom, the horizontal roping of the hoisting ropes develop sagging, which is restrained by means of auxiliary trolleys. As a result of the trolley moving along the entire length of the boom, the auxiliary trolleys with the supporting rope pulleys that support the hoisting ropes must be able to move and give way to the trolleys because otherwise there could be, instead of the trolley, static rope pulleys supported to the boom. An auxiliary trolley usually runs at the mid-point of the rope length being supported, whereby sagging may be most effectively prevented. Excess sagging causes the ropes to shift off their rope pulleys. Ropes that are sagging also cause noise.

When a ship arrives at a quay alongside a crane, the boom (part of the boom) is usually raised to an upper position to make room. Once the ship has settled in place, the boom may again be lowered to its normal use position, a horizontal lower position.

Raising the boom to the upper position requires special arrangements for the drive roping of the auxiliary trolleys so that the point of the folding joint of the boom, insofar as the roping is concerned, may be passed. This is due to the fact that the drive roping of the auxiliary trolleys travels along different lines than the hoisting ropes of the actual trolley. However, the drive roping of the auxiliary trolleys is used from the trolley, and as the trolley is moving, the auxiliary trolleys typically move at half the speed of the trolley. All this requires separate systems to tighten the ropings of the auxiliary trolleys in a usage situation and to compensate for the geometrical changes in a boom raising situation.

When the length of the boom is increased, the need to tighten all the ropes increases. In prior art, hydraulic tighteners and tension weights are used to tighten ropings of auxiliary trolleys. The tension weights may be very heavy-duty with a mass that may exceed ten tons. Hydraulic tighteners, on their part, require the building of hydraulic systems to the crane boom including a hydraulic machine unit.

SUMMARY OF THE INVENTION

An object of the invention is to improve the STS crane described in the above in such a manner that the aforementioned problems are solved. This object is achieved by the STS crane according to the invention, which is characterised in that there are auxiliary trolley rails arranged on the boom for supporting the auxiliary trolleys and for their movement, these auxiliary trolley rails being separate from the trolley rails; and in that the drive roping of the auxiliary trolleys is divided into two separate and independent drive ropings which have separate and independent drive mechanisms and which are on different sides of the folding joint on the boom.

Preferred embodiments of the invention are disclosed in the dependent claims.

The invention is based on the fact that the auxiliary trolleys have now been arranged with their own travelling rails and the drive roping of the auxiliary trolleys has been "cut", that is, divided into two parts, fully independent of the trolley, on both sides of the folding joint on the boom.

In the crane according to the invention, raising a boom does not result in any special arrangements to pass the folding joint as regards the ropes when the mechanical solutions and equipment become simpler. When a boom is raised, the auxiliary trolley on the side of the ship or waterway is advantageously driven close to the folding joint, against bumpers. Near the boom, maintenance work is temporally more flexible when the movement of the auxiliary trolleys and the movement of the trolley are not linked. The new arrangement additionally makes the boom easier to service on both ends. Furthermore, the operation of the auxiliary trolley may be decoupled from hoisting operations should a fault occur in the actual trolley. The auxiliary trolley or auxiliary trolleys may be separately driven to the end of the auxiliary trolley rails for service, while the actual hoisting activities may be continued, obviously taking into account larger rope sagging. The auxiliary trolleys may be made considerably more light-weight, whereby the tightening devices of their drive ropings and drive mechanisms may be made for a smaller tightening capacity and without "dead" weights, or the alternative hydraulic system may be entirely avoided. As a result of the lighter structure of the auxiliary trolleys, the auxiliary trolley rails may also be made more light-weight than previously.

LIST OF FIGURES

Figure 2:
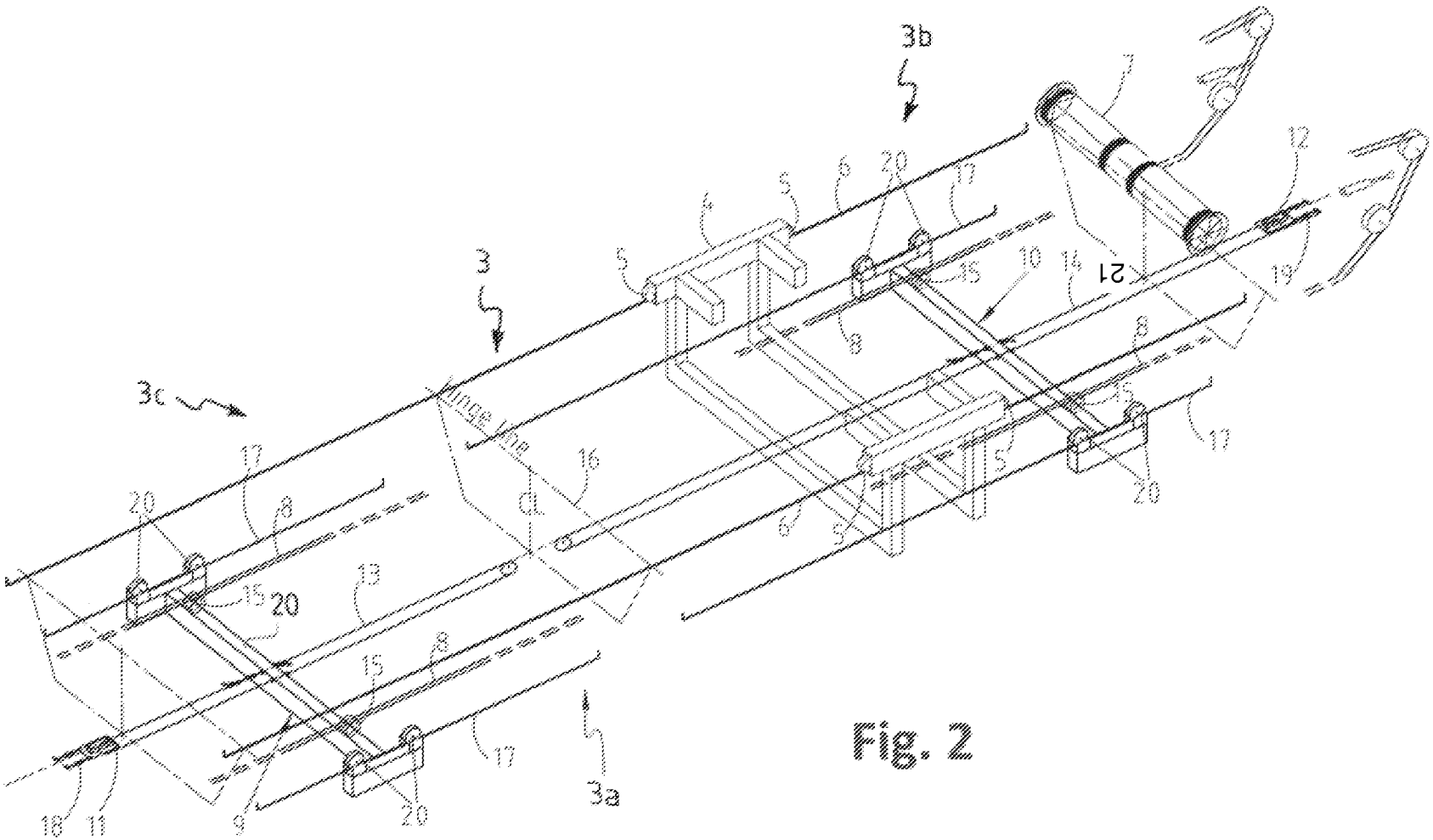

The invention is now described in closer detail by means of an implementation example and with reference to the accompanying drawings, in which FIG. 1 is an overall view of an STS crane at a port; and FIG. 2 is a simplified perspective view showing the principle of an STS crane boom with the associated basic components.

DETAILED DESCRIPTION OF THE INVENTION

The STS crane of the drawings has a gantry-like portal frame structure 1 arranged to move, supported by wheels 2, along rails R arranged on a quay Q. To the top part of the portal frame structure 1, a boom 3 is supported, substantially horizontal in its operating position and having a portion 3*a* intended to extend to the side of a ship S alongside the quay Q, and a portion 3*b* intended to extend to the side of the quay Q. A trolley 4, supported to wheels 5, is arranged to move along the boom 3, supported by trolley rails 6 arranged on the boom 3. On top of the boom 3, advantageously near the portal frame structure 1 or supported to it, a hoisting mechanism is arranged, which has a rope drum 7 for hoisting ropes 8, whereby these hoisting ropes 8 have been guided from the rope drum 7 through the ends of the boom 3 to the trolley 4. In the trolley 4, the hoisting ropes 8 are led through sheave systems to a hoisting member of the trolley 4, but these elements unessential from the point of the invention are not shown in the drawings.

In addition, along the boom, on both sides of the trolley 4, auxiliary trolleys 9, 10 have been arranged, which are arranged to move along the boom 3 and the purpose of which is to support and/or tighten the hoisting ropes 8. To move the auxiliary trolleys 9, 10, a drive mechanism arrangement 11, 12 with drive ropings 13, 14 have been arranged. To support and/or tighten the hoisting ropes 8, the auxiliary trolleys 9, 10 have support rope pulleys 15 which are provided with rope grooves and on which the hoisting ropes 8 rest. The support pulleys 15 are advantageously plastic. When the drive roping 13, 14 passes over the frame of the auxiliary trolley 9, 10, there is a sliding surface 20 installed on the surface of this frame, over which the drive roping 13, 14 may slide. The sliding surface 20 is advantageously plastic.

For the ship S to be unloaded at a port to get alongside the quay Q without problems, the portion 3*a* of the boom 3 of the STS crane, extending in the ship's direction, has a folding joint 16 for the purpose of folding up a folding portion 3*c* extending further from this joint in the direction of the ship S.

It is essential from the viewpoint of the invention that there are auxiliary trolley rails 17 arranged on the boom 3 for supporting the auxiliary trolleys 9, 10 and for their movement on wheels 20, these auxiliary trolley rails being separate from the trolley rails 6; and in that the drive roping 13, 14 of the auxiliary trolleys 9, 10 is divided into two separate and independent drive ropings 13, 14 which have separate and independent drive mechanisms 11, 12 and which are on different sides of the folding joint 16 on the boom 3. The drive ropings 13, 14 are advantageously on the centre line between the auxiliary trolley rails 17, whereby the movement of the auxiliary trolley 9, 10 is easiest managed, that is, synchronised. The auxiliary trolley 9, 10 is relatively lightweight, so it may be moved by a single rope rotation.

The auxiliary trolley rails 17 are located fixed to the lower surfaces of the boom portions 3*a*, 3*b*, 3*c*, on the inside of the vertical planes running through the trolley rails 6, advantageously lower than the trolley rails 6. It is possible to build extensions to the auxiliary trolley rails 17 in the area of the ends of the boom 3, whereby this allows the forming of a separate servicing and transport station. So, the sum of the lengths of the auxiliary trolley rails 17, calculated past the folding joint 16, may be higher than the sum of the lengths of the actual trolley rails 6. A sea transport of an entire STS crane takes place on a ship's deck from the manufacturing site to the destination port so that there are often a plurality of parallel cranes on the ship, in other words, successively on the deck in the direction of travel of the ship. The auxiliary trolleys 9, 10 may be locked in a transport position by sea straps or welding them temporarily so that the auxiliary trolleys 9, 10 do not move during transport.

The drive mechanism 11, 12 of the auxiliary trolleys 9, 10 are located at the ends of the boom 3. The drive ropings 13, 14 related to the drive mechanisms 11, 12 are advantageously pre-stretched and connected to length adjustment and tightening devices 18, 19 which may be mechanical or electrical. The length adjustment and tightening devices 18, 19 may, in addition to the required tension, also take care of braking the movement of the auxiliary trolley 9, 10. The auxiliary trolleys 9, 10 may be controlled from a separate local control box as desired, for example to a hoisting operation or maintenance position. Control of the auxiliary trolleys 9, 10 may be separate for both trolleys 9, 10. With local control selected, the actions by the crane operator are temporality bypassed.

The above description of the invention is only intended to illustrate the basic idea of the invention. A person skilled in the art may, however, implement its details within the scope of the attached claims.

The invention claimed is:

1. A ship-to shore (STS) crane comprising:

a portal frame structure;

a boom supported to a top part of the portal frame structure and having a portion intended to extend to a side of a ship and a portion intended to extend to a quay side;

a trolley adapted to move along the boom, the trolley being supported by trolley rails arranged thereon;

a hoisting mechanism arranged on top of the boom and having a rope drum for hoisting ropes, whereby the hoisting ropes are routed from the rope drum through boom ends to the trolley;

auxiliary trolleys arranged to move along the boom on both sides of the trolley to support and/or tighten the hoisting ropes;

a drive mechanism and drive roping of the auxiliary trolleys for moving the auxiliary trolleys; and a folding joint on the boom portion intended to extend on the side of the ship for folding up the folding portion of the boom extending to the direction of the ship from the folding joint, wherein auxiliary trolley rails are arranged on the boom for supporting the auxiliary trolleys and for their movement, these auxiliary trolley rails being separate from the trolley rails;

wherein the drive roping of the auxiliary trolleys is divided into two separate and independent drive ropings which have separate and independent drive mechanisms and which are on different sides of the folding joint on the boom, and wherein the auxiliary trolley rails are designed for a smaller load than the trolley rails.

2. The STS crane as claimed in claim 1, wherein the trolley rails and auxiliary trolley rails run in parallel so that the auxiliary trolley rails are located on the inside of the vertical planes running through the trolley rails.

3. The STS crane as claimed in claim 1, wherein the auxiliary trolley rails are located on the inside of the vertical planes running through the trolley rails lower than the trolley rails.

4. The STS crane as claimed in claim 1, wherein the auxiliary trolley rails are longer than the trolley rails.

5. The STS crane as claimed in claim 1, wherein the drive mechanisms of the auxiliary trolleys are located at the ends of the boom.

6. The STS crane as claimed in claim 1, wherein the drive ropings of the auxiliary trolleys are pre-stretched.

7. The STS crane as claimed in claim 1, wherein the drive ropings of the auxiliary trolleys have length adjustment and tightening devices.

8. The STS crane as claimed in claim 7, wherein the length adjustment and tightening devices are mechanical.

9. The STS crane as claimed in claim 7, wherein the length adjustment and tightening devices are electrical.

10. A ship-to shore (STS) crane comprising:

a portal frame structure;

a boom supported to a top part of the portal frame structure and having a portion intended to extend to a side of a ship and a portion intended to extend to a quay side;

a trolley adapted to move along the boom, the trolley being supported by trolley rails arranged thereon;

a hoisting mechanism arranged on top of the boom and having a rope drum for hoisting ropes, whereby the hoisting ropes are routed from the rope drum through boom ends to the trolley;

auxiliary trolleys arranged to move along the boom on both sides of the trolley to support and/or tighten the hoisting ropes;

a drive mechanism and drive roping of the auxiliary trolleys for moving the auxiliary trolleys; and a folding joint on the boom portion intended to extend on the side of the ship for folding up the folding portion of the boom extending to the direction of the ship from the folding joint, wherein auxiliary trolley rails are arranged on the boom for supporting the auxiliary trolleys and for their movement, these auxiliary trolley rails being separate from the trolley rails;

wherein the drive roping of the auxiliary trolleys is divided into two separate and independent drive ropings which have separate and independent drive mechanisms and which are on different sides of the folding joint on the boom, and wherein the drive mechanisms of the auxiliary trolleys are located at the ends of the boom.

11. A ship-to shore (STS) crane comprising:

a portal frame structure;

a boom supported to a top part of the portal frame structure and having a portion intended to extend to a side of a ship and a portion intended to extend to a quay side;

a trolley adapted to move along the boom, the trolley being supported by trolley rails arranged thereon;

a hoisting mechanism arranged on top of the boom and having a rope drum for hoisting ropes, whereby the hoisting ropes are routed from the rope drum through boom ends to the trolley;

auxiliary trolleys arranged to move along the boom on both sides of the trolley to support and/or tighten the hoisting ropes;

a drive mechanism and drive roping of the auxiliary trolleys for moving the auxiliary trolleys; and a folding joint on the boom portion intended to extend on the side of the ship for folding up the folding portion of the boom extending to the direction of the ship from the folding joint, wherein auxiliary trolley rails are arranged on the boom for supporting the auxiliary trolleys and for their movement, these auxiliary trolley rails being separate from the trolley rails;

wherein the drive roping of the auxiliary trolleys is divided into two separate and independent drive ropings which have separate and independent drive mechanisms and which are on different sides of the folding joint on the boom, and wherein the drive ropings of the auxiliary trolleys are pre-stretched.

* * * * *